US007810271B2

(12) United States Patent
Patel

(10) Patent No.: US 7,810,271 B2
(45) Date of Patent: Oct. 12, 2010

(54) MODULAR RIFLE SYSTEMS AND METHODS

(75) Inventor: Swetal K. Patel, Dallas, GA (US)

(73) Assignee: Bushmaster Firearms International, LLC, Windham, ME (US)

( * ) Notice: Subject to any disclaimer, the term of this patent is extended or adjusted under 35 U.S.C. 154(b) by 635 days.

(21) Appl. No.: 11/789,329

(22) Filed: Apr. 24, 2007

(65) Prior Publication Data

US 2010/0229445 A1 Sep. 16, 2010

(51) Int. Cl.
*F41A 11/02* (2006.01)

(52) U.S. Cl. ..... 42/75.03

(58) Field of Classification Search ..... 42/75.03
See application file for complete search history.

(56) References Cited

U.S. PATENT DOCUMENTS 2,951,424 A 9/1960 Stoner
4,924,615 A * 5/1990 Ives ..... 42/85
5,410,834 A * 5/1995 Benton et al. ..... 42/75.02
2006/0026883 A1 * 2/2006 Hochstrate et al. ..... 42/75.01

OTHER PUBLICATIONS

Cobb Manufacturing, Inc., http://www.cobb50.com/mcr.htm.
MG Industries, http://www.mgimilitary.com/Lower_Receiver_Mult_Mag_Wells.htm.
Unknown, Cobb Manufacturing, Inc., Tactical Gear Magazine, Spring 2007, pp. 44-45, Brad Rucks, Iola, WI.
Gary Paul Johnston, Replacing the M16, Combat Arms, date unknown, pp. 26-31, Chris Agnes.
Unknown, Special Operations Forces Combat Assault Rifle (SCAR), Product Sample Operators Manual, May 31, 2004, pp. 1-26, Cobb Manufacturing, Inc.

* cited by examiner

*Primary Examiner*—Stephen M Johnson
(74) *Attorney, Agent, or Firm*—Pierce Atwood LLP; Kevin M. Farrell; Katherine A. Wrobel

(57) ABSTRACT

In embodiments, a modular rifle includes a lower receiver assembly, an upper receiver, and a coupling mechanism. The lower receiver assembly that can be separated into a lower receiver portion and a magazine well portion. The coupling mechanism is configured to releasably couple the portions of the lower receiver assembly together. The coupling mechanism including an aperture and a pin that can be moved into and out of the aperture. The upper receiver is releasably coupled to the lower receiver assembly.

18 Claims, 5 Drawing Sheets

MODULAR RIFLE SYSTEMS AND METHODS

TECHNICAL FIELD

The present disclosure generally relates to weapons systems and methods, and more particularly relates to modular rifle systems, and methods of reconfiguring rifles.

BACKGROUND

A rifle is a type of weapon that fires rounds. Typically, the rifle includes a trigger, a hammer, and a barrel. The round is positioned in the barrel, and when the trigger is pulled, the hammer fires the round through the barrel. One type of rifle is an M16-style rifle that features a gas-operated bolt and bolt carrier system as disclosed in U.S. Pat. No. 2,951,424, issued to Eugene M. Stoner on Sep. 6, 1960 and incorporated by reference herein in its entirety. The M16-style rifle is the weapon used by many military and civilian police forces today.

Typically, M16-style rifles include a lower receiver that houses the trigger and hammer, and an upper receiver that houses the barrel, bolt, and bolt carrier. The lower receiver and the upper receiver are detachably coupled together using a coupling mechanism, so that the rifle can be moved with relative ease between an assembled position suited for firing, and a disassembled position suited for cleaning the rifle and for repairing its internal parts. A conventional takedown system features front and rear pins slidably positioned in the lower receiver, and corresponding front and rear connector tabs extending from the upper receiver. A distance between the pins on the lower receiver corresponds to a distance between the connector tabs on the upper receiver, so that the pins can be pushed into and out of the connector tabs to selectively attach and detach the upper and lower receivers.

In some cases, the upper receiver can be substituted with a different upper receiver, such as a close quarters battle receiver (CQBR), which is a replacement upper receiver having a relatively shorter barrel. Like the conventional upper receiver, the CQBR has connector tabs that are separated by a distance corresponding to the distance between the pins on the lower receiver, so that the CQBR can be coupled to the lower receiver. In the field, the CQBR is employed during indoor operations or other operations in which a longer barrel rifle may be cumbersome to maneuver.

While the barrel length of the M16-style rifle can be changed with relative ease, the size of the rounds fired by the M16-style rifle cannot. Typically, the lower receiver has an integrally connected magazine well that is configured to receive a magazine, and the magazine is configured to hold the rounds. Because the magazine well can only be used with certain magazines, and each magazine can only be used with certain rounds, the size of the rounds that can be fired by the M16-style rifle is restricted.

In limited cases, the M16-style rifle may be reconfigured to fire rounds of other sizes, such as by manually rigging the magazine well to accept a non-standard magazine. Even with manual reconfiguration, however, most M16-style rifles cannot fire particularly large rounds because the magazine well is too small. In such cases, the lower receiver can be substituted with another lower receiver having an appropriately configured magazine well. However, substituting the lower receiver may be undesirable because the lower receiver of each M16-style rifle is tracked by the U.S. government, and requires a Federal Firearms License (FFL). Further, the substitute lower receiver may have pins that are separated by a distance that is different than the distance between the connecting tabs on the upper receiver. Therefore, when the lower receiver is substituted, it may be necessary to substitute the upper receiver with a different upper receiver having appropriately spaced connecting tabs.

SUMMARY

In embodiments, a modular rifle includes a lower receiver assembly, an upper receiver, and a coupling mechanism. The lower receiver assembly that can be separated into a lower receiver portion and a magazine well portion. The coupling mechanism is configured to releasably couple the portions of the lower receiver assembly together. The coupling mechanism includes an aperture and a pin that can be moved into and out of the aperture. The upper receiver is releasably coupled to the lower receiver assembly.

In embodiments, a modular rifle system includes a lower receiver portion, a plurality of upper receivers, and a plurality of magazine well portions. Each upper receiver is configured to releasably couple to the lower receiver portion. Each magazine well portion is configured to releasably couple to the lower receiver portion and to at least one of the upper receivers. A modular rifle is formed by releasably coupling the lower receiver portion to a selected one of the magazine well portions and a selected one of the upper receivers.

In embodiments, a modular rifle system includes a first magazine well portion configured to receive a first magazine and a second magazine well portion configured to receive a second magazine. The second magazine is different in shape than the first magazine. The modular rifle system further includes a lower receiver assembly portion configured to releasably couple to any one of the magazine well portions. A first lower receiver assembly is formed by coupling the lower receiver portion to the first magazine well portion and a second lower receiver assembly is formed by coupling the lower receiver portion to the second magazine well portion. The modular rifle system also includes a first upper receiver configured to releasably couple to the first lower receiver assembly to form a first rifle, and a second upper receiver configured to releasably couple to the second lower receiver assembly to form a second rifle.

In embodiments, a modular rifle system includes a lower receiver portion, an upper receiver, a plurality of magazine well portions, and a coupling mechanism. The upper receiver is configured to releasably couple to the lower receiver portion. Each magazine well portion is configured to releasably couple to the lower receiver portion and to the upper receiver. Each magazine well portion accepts a magazine of a unique size and shape. The coupling mechanism is configured to releasably couple the lower receiver portion to one of the magazine well portions. The coupling mechanism includes a pin that is received within an aperture.

In embodiments, a method of forming a plurality of independent modular rifles includes selecting one of a plurality of magazine wells and selecting one of a plurality of upper receivers, assembling a first rifle by attaching a lower receiver portion to the first selected magazine well and the first selected upper receiver, disassembling the first rifle, selecting one of the plurality of magazine wells and selecting one of the plurality of upper receivers, assembling a second rifle by attaching the lower receiver portion to the second selected magazine well and the second selected upper receiver.

In embodiments, a method of reconfiguring a modular rifle includes removing an upper receiver from a lower receiver assembly of a modular rifle, separating the lower receiver assembly into a lower receiver portion and a first magazine well, replacing the first magazine well with a second magazine well, attaching the second magazine well to the lower receiver portion to reassemble the lower receiver assembly; and attaching an upper receiver to the lower receiver assembly to form a reconfigured modular rifle.

Other systems, devices, methods, features, and advantages of the disclosed modular rifle systems and methods will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Figure 1:
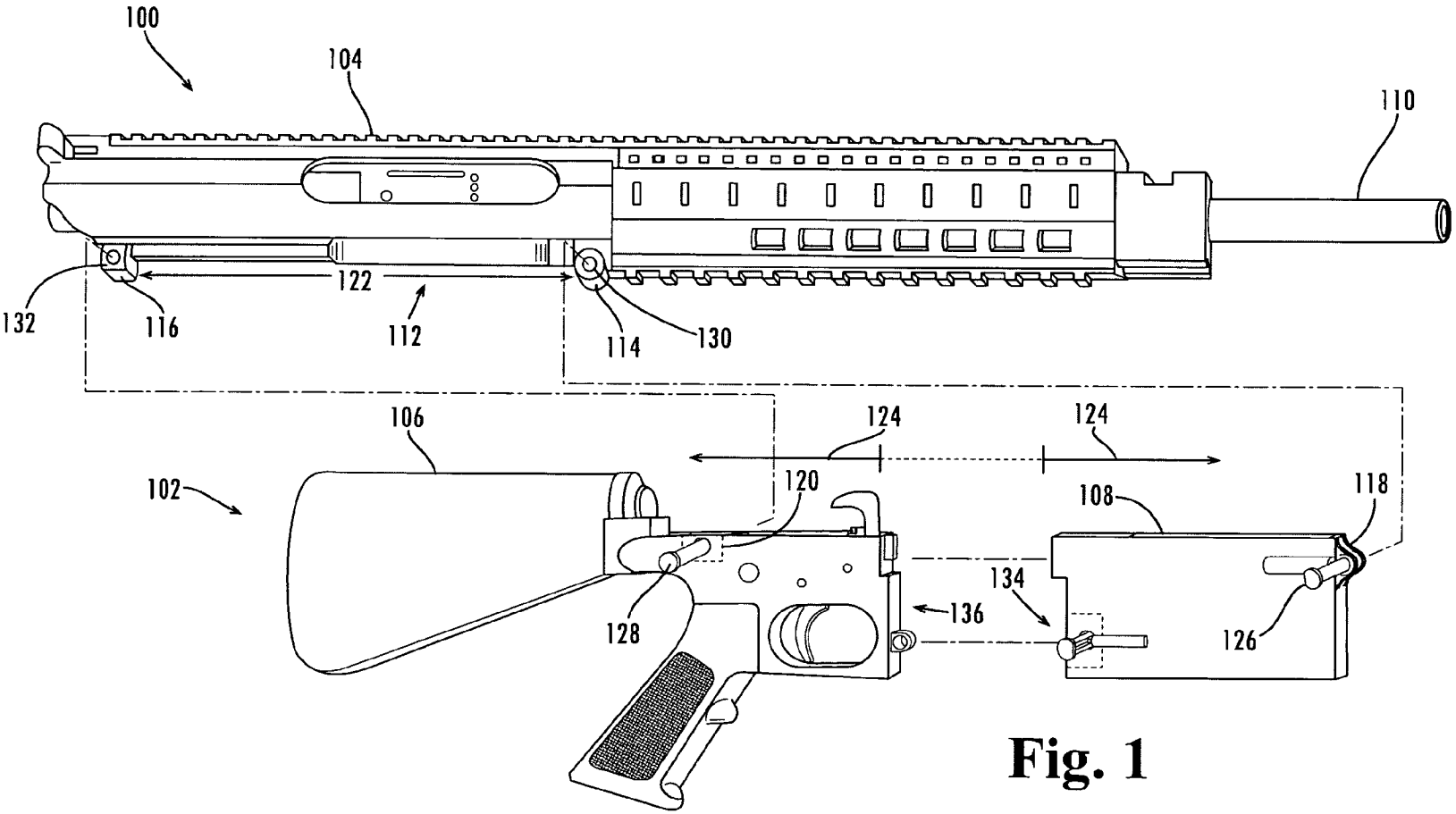
FIG. 1 is an exploded perspective view of an embodiment of a modular rifle.

Disclosed below are embodiments of modular rifle systems and methods. FIG. 1 is an exploded perspective view of an embodiment of a modular rifle 100. The modular rifle 100 includes a lower receiver assembly 102 and an upper receiver 104. Like a conventional rifle, the lower receiver assembly 102 can be releasably coupled to the upper receiver 104. Unlike a conventional lower receiver, however, the lower receiver assembly 102 can be separated into two pieces, including a lower receiver portion 106 and a magazine well portion 108, so that the magazine well portion 108 can be replaced to, for example, reconfigure the modular rifle 100 to fire rounds of a different size.

With reference to FIG. 1, the modular rifle 100 is configured to fire rounds of a particular size. More specifically, the lower receiver portion 106 includes a trigger that actuates a hammer to fire a round positioned in the upper receiver 104. The upper receiver 104 includes a barrel 110 that is sized and shaped to receive the round, and an opening 112 that enables passing the round into the barrel 110. The magazine well portion 108 is configured to hold a magazine of rounds, and to supply the rounds to the barrel 110 through the opening 112.

The lower receiver assembly 102 and the upper receiver 104 are releasably coupled together using a coupling mechanism 103. The coupling mechanism 103 is selectively releasable so that the modular rifle 100 can be moved between an assembled position and a disassembled position. In the assembled position, the lower receiver assembly 102 is coupled to the upper receiver 104 so that the modular rifle 100 can fire the round. In the disassembled position, the upper receiver 104 is at least partially separated from the lower receiver assembly 102 so that the modular rifle 100 can be cleaned or serviced.

In some embodiments, the coupling mechanism 103 is a takedown assembly, although the coupling mechanism 103 can have any configuration that is known to a person of skill or is subsequently developed. An embodiment of a takedown assembly is shown in FIG. 1. Specifically, the upper receiver 104 includes a forward connecting projection 114 and a rearward connecting projection 116. The connecting projections 114, 116, are of the conventional type and extend downward from a lower side of the upper receiver 104. Positioned on an upper side of the lower receiver assembly 102 are a forward pair of connecting tabs 118 and a rearward recess 120. Specifically, the forward pair of connecting tabs 118 extend from a forward side of the magazine well portion 108 and the rearward recess 120 is formed in an upper side of the lower receiver portion 106.

So that the upper receiver 104 and the lower receiver assembly 102 can be assembled together, the forward connecting projection 114 is sized and shaped to mate with the forward pair of connecting tabs 118, and the rearward connecting projection 116 is sized and shaped to mate with a rearward recess 120. A distance 122 between the connecting projections 114, 116, on the upper receiver 104 is substantially the same as a distance 124 between the forward pair of connecting tabs 118 and the rearward recess 120 on the lower receiver assembly 102. When assembled, the movement of the lower receiver assembly 102 with respect to the upper receiver 104 is restricted in the axial and lateral directions due to the mating shapes of the connecting projections 114, 116 with the forward pair of connecting tabs 118 and the rearward connecting projection 116.

In some cases, the connecting projections 114, 116 may be keyed so that the upper receiver 104 is restricted in the axial and lateral directions due to and lower receiver assembly 102 fit together only in the intended orientation. For example, the rearward connecting projection 116 may have a different shape than the forward connecting projection 114, and the rearward recess 120 may be shaped to mate with the rearward connecting projection 116 but not the forward connecting projection 114.

So that the upper receiver 104 and the lower receiver assembly 102 can be coupled together, the magazine well portion 108 includes a forward pin 126 positioned adjacent the forward pair of connecting tabs 118, and the lower receiver portion 106 includes a rearward pin 128 positioned adjacent the rearward recess 120. Each of the pins 126, 128 is configured to be moved between a locked position in which the pin 126 or 128 extends through the corresponding tabs 118 or recess 120, and an unlocked position in which the pin 126 or 128 does not extend through the corresponding pair of tabs 118 or recess 120. Both the forward pin 126 and the rearward pin 128 may be conventional retaining pins that cannot be completely removed from the modular rifle 100, reducing the risk of loss during disassembly. For example, each retaining pin may have a groove extending along a length of the pin that abruptly terminates before a distal end of the pin, and a spring may engage the groove to prevent the distal end of the pin from exiting the modular rifle 100. Each of the connecting projections 114, 116 includes an aperture 130, 132 that is sized, shaped, and positioned to receive the corresponding pin 126, 128. To couple the upper receiver 104 to the lower receiver assembly 102, the apertures 130, 132 receive the pins 126, 128 to lock the connecting projections 114, 116 in the corresponding pair of tabs 118 or recess 120.

For the purposes of this disclosure, terms such as axial, lateral, vertical, forward, rearward, upper, and lower, among others, are used to provide a relative frame of reference for explanatory purposes and are not intended to limit the disclosure. For example, the term axial generally denotes a direction substantially parallel to a longitudinal length of the modular rifle 100, while the term lateral generally denotes a direction substantially perpendicular to a plane that bisects the modular rifle 100. The term vertical generally denotes a direction that is substantially perpendicular to the axial and lateral directions. The vertical direction is substantially perpendicular to the ground when the modular rifle 100 held with the barrel 110 substantially parallel to the ground, but not otherwise.

As mentioned above, the lower receiver portion 106 and the magazine well portion 108 of the lower receiver assembly 102 are two separable pieces. The lower receiver assembly 102 further includes a coupling mechanism 135 that is configured to releasably couple the lower receiver portion 106 and the magazine well portion 108 together. Although the coupling mechanism 135 can have a range of configurations, in the illustrated embodiment the magazine well portion 108 includes a coupling component 134 and the lower receiver portion 106 includes a coupling component 136. The coupling components 134, 136 are configured to releasably engage each other to couple the lower receiver assembly 102 together.

Figure 2:
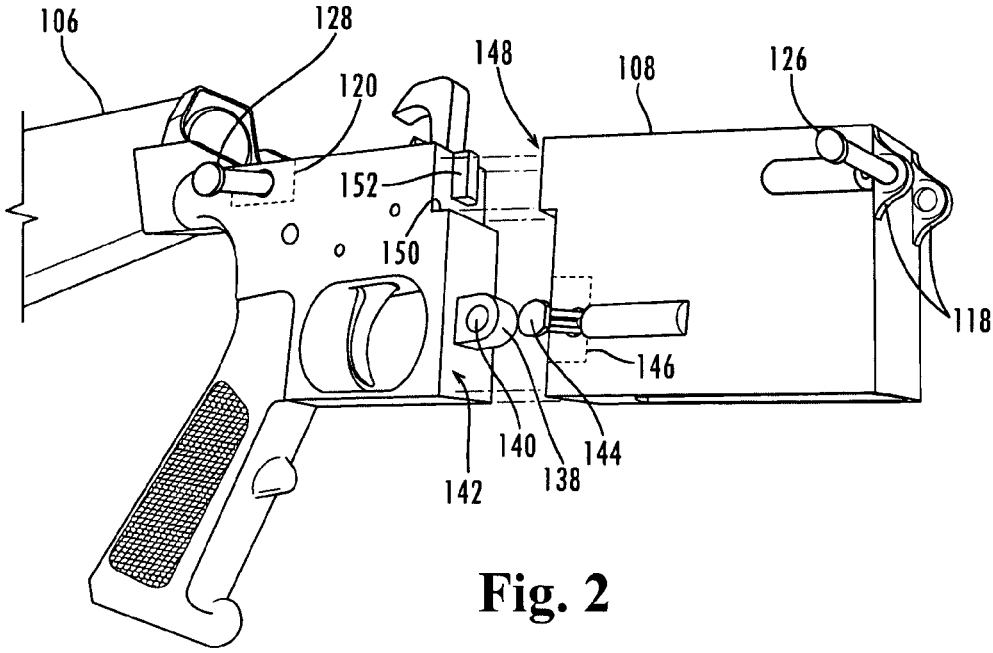
FIG. 2 is a partial cut-away, perspective view of an embodiment of a lower receiver assembly of the modular rifle shown in FIG. 1.
Figure 3:
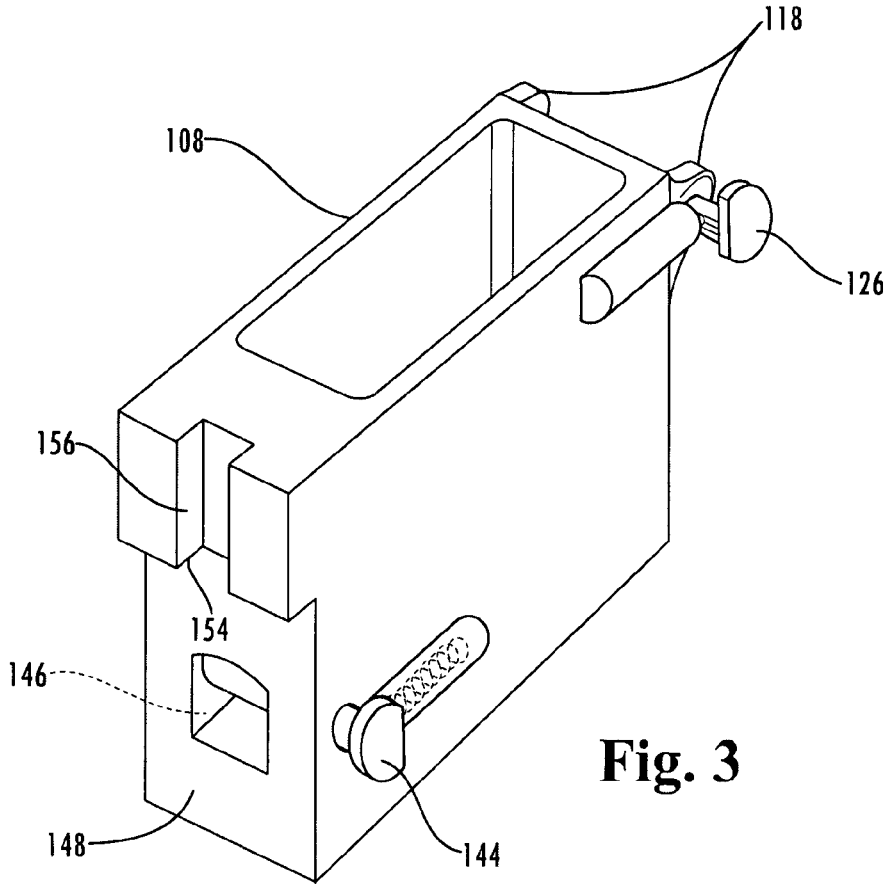
FIG. 3 is a perspective view of an embodiment of a magazine well portion of the modular rifle shown in FIG. 1.

An example of such an embodiment is described below with reference to FIGS. 2 and 3, FIG. 2 being a partial cutaway perspective view of an embodiment of a lower receiver portion 106 and FIG. 3 being a perspective view of an embodiment of the magazine well portion 108. As shown, the coupling component 136 on the lower receiver portion 106 is a connecting projection 138 extending from a forward side 142 of the lower receiver portion 106, the connecting projection 138 having an aperture 140. The coupling component 134 on the magazine well portion 108 is a pin 144 position adjacent a recess 146 formed on a rearward side 148 of the magazine well portion 108. The connecting projection 138, aperture 140, pin 144, and recess 146 can be similar in configurations to components described above with reference to the takedown assembly that couples the upper receiver 104 to the lower receiver assembly 102. For example, the connecting projection 138 can be sized and shaped to mate with the recess 146, and the pin 144 can be moveable between a first position extending through the recess 146, and a second position not extending through the recess 146. When the connecting projection 138 is in the recess 146 and the pin 144 is in the first position, the pin 144 extends through the aperture 140 to couple the portions 106, 108 of the lower receiver assembly 102 together. It should be noted that in some cases, the configuration can be reversed, such that the recess 146 and pin 144 are positioned on the forward side 142 of the lower receiver portion 106, and the connecting projection 138 and aperture 140 are positioned on the rearward side 148 of the magazine well portion 108.

As illustrated, the coupling mechanism 135 used to couple the lower receiver portion 106 to the magazine well portion 108 may be user-friendly because the hand motions employed to operate the coupling mechanism 135 are similar to the hand motions employed to operate the takedown assembly. Further, the illustrated coupling mechanism 135 may be operated relatively quickly and may be relatively robust, which may be desirable in the military and police arenas where speed and reliability of operation are critical.

In some embodiments, the forward side 142 of the lower receiver portion 106 is shaped to mate with the rearward side 148 of the magazine well portion 108. For example, the forward side 142 of the lower receiver portion 106 may include a ledge 150 and a projecting tab 152, and the rearward side 148 of the magazine well portion 108 may include an indent 154 and a slot 156. The ledge 150 and indent 154 are sized and shaped to mate with each other to align the lower receiver portion 106 and the magazine well portion 108 in the axial and vertical directions, while the projecting tab 152 and the slot 156 are sized and shaped to mate with each other to align the lower receiver portion 106 and the magazine well portion 108 in the lateral direction. When so aligned, the coupling mechanism 135 maintains the alignment of the portions 106, 108 of the lower receiver assembly 102 with respect to each other. However, in other embodiments, the forward side 142 of the lower receiver portion 106 and the rearward side 148 of the magazine well portion 108 can have other shapes and configurations that may or may not be configured to maintain the associated portions 106, 108 of the lower receiver assembly 102 in alignment. For example, the configuration can be reversed, such that the forward side 142 of the lower receiver portion 106 includes the indent 154 and a slot 156, and the rearward side 148 of the magazine well portion 108 includes the ledge 150 and the projecting tab 152.

In the illustrated embodiment, the modular rifle 100 is an M16-style rifle. For the purposes of this disclosure, the term "M16-style rifle" generally refers to the M16 automatic rifle commonly associated with the U.S. military. The M16 rifle is a gas-operated rifle having a bolt and bolt carrier (not shown). Typically, the M16 is configured to fire .223 caliber rounds or other comparable rounds, such as 5.56×45 mm NATO rounds.

The term "M16-style rifle" also refers to variants of the M16, which includes rifles sharing a commonality of parts with the M16 and rifles that are derived from the M16. One example variant of the M16 is the AR-15 rifle, which is the semiautomatic civilian version of the M16. Other example variants of the M16 include rifles identified by the following appellations: XM16, XM16E1, M16A1, M16A2, M16A2E1, M16A2E2, M16A2E3, M16A2E4, M16A3, M16A4, XM177, XM177E1, XM177E2, CAR-15, M4 Carbine, M4A1 Carbine, M4E2, M4 MWS, Mk 4 Mod 0, M231, M231 FPW, KH2002, S5.56, MSSR, NORCINCO, M311/CQ, AR-10, M14, M14 SMUD, GUU-5/P, Diemaco C7, Diemaco C8, SDM-R, SAM-R, Mark 11 SWS, Mark 12 SPR, SEAL Recon Rifle, Mark 18 CQBR, Ares Shrike, La France M16K, KAC SR-25, M249, XM8, MK16, FN SCAR Colt Commando, Colt Models 601, 602, 603, 604, 645, 645E, 646, 655, 656, 723, 725, 733, 920, 921, 921HB, 925 and 945. Still other variants of the M16 that are known now or are developed later are intended to be included within the scope of the term "M16-style rifle", as understood by a person of skill in the art.

Because the modular rifle 100 in the illustrated embodiment is an M16-style rifle, the magazine well portion 108 is sized and shaped to hold a magazine of .223 caliber rounds, the lower receiver portion 106 is an M16-style lower receiver portion that may include internal parts commonly found on an M16-style rifle and/or may be sized and shaped in a comparable manner to an M16-style rifle, and the upper receiver 104 includes a barrel 110 that is sized and shaped to receive .223 caliber rounds for firing. Further, the upper receiver 104 includes a bolt and bolt carrier (not shown), such that the modular rifle 100 is gas-operated. The modular rifle 100 may also include other conventional features of any of the M16-style rifles referred to above.

In other embodiments, however, the modular rifle 100 may be a rifle style other than an M16-style rifle. Suitable other rifle styles include rifles of the type that have a lower receiver and an upper receiver releasably coupled together using a coupling mechanism, the lower receiver having a magazine well configured to receive a magazine of rounds of a particular size, and the upper receiver having a barrel sized to receive the rounds of the particular size for firing, among other rifles.

These other rifles styles may or may not be gas-operated, and may or may not include a bolt and bolt carrier.

Figure 4:
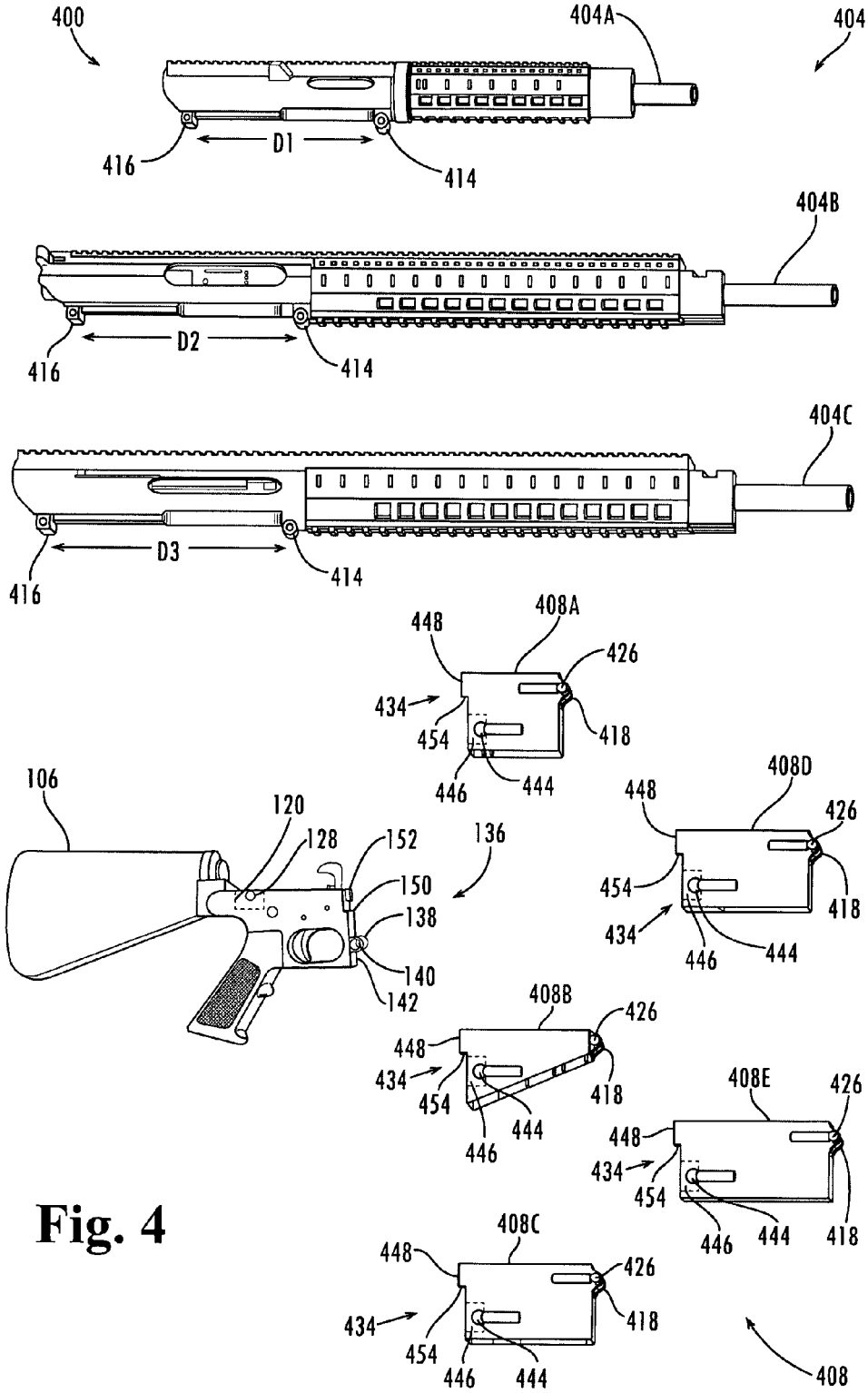
FIG. 4 is a plan view of an embodiment of a modular rifle system.

FIG. 4 is a plan view of an embodiment of a modular rifle system 400. The modular rifle system 400 includes a lower receiver portion 106, a plurality of magazine well portions 408, and a plurality of upper receivers 404. As shown, the lower receiver portion 106 is an embodiment of the M16-style lower receiver portion 106 described above, although other embodiments may have other configurations. Each magazine well portion 408 is configured to releasably couple to the lower receiver portion 106 and to at least one of the upper receivers 404. Further, each upper receiver 404 is configured to releasably couple to the lower receiver portion 106 and to at least one of the magazine well portions 408. Thus, a modular rifle can be formed by releasably coupling the lower receiver portion 106 to a selected one of the plurality of magazine well portions 408 and a selected one of the plurality of upper receivers 404.

More specifically, when the lower receiver portion 106 and the selected magazine well portion 408 are coupled together, a lower receiver assembly is formed that can be coupled to a selected upper receiver 404 to form a selected modular rifle. When the lower receiver portion 106 and a different magazine well portion 408 are coupled together, a different lower receiver assembly is formed that can be coupled to an upper receiver 404 to form a different modular rifle 100.

Each magazine well portion 408 is configured to accept a magazine. The shape of the magazine may be affected by the size of the round that the magazine holds or other characteristics such as the manufacturer of the magazine. Therefore, magazines of different shapes may hold different sized rounds, or may hold the same sized rounds but may have different exterior shapes. Because magazines have a variety of shapes, the magazine well portions 408 also have a variety of shapes, each magazine well portion 408 accepting at least one type of magazine. In the illustrated embodiment, the plurality of magazine well portions 408 includes a magazine well portion 408A configured to accept a magazine of .223 caliber rounds, a magazine well portion configured to accept a magazine of 9 mm rounds (not shown), a magazine well portion 408B configured to accept a magazine of .308 caliber rounds, a magazine well portion 408C configured to accept a magazine of .30-06 caliber rounds, a magazine well portion 408D configured to accept a magazine of 7.62 mm rounds, and a magazine well portion 408E configured to accept a magazine of .338 caliber rounds. One type of .338 caliber round is the .338 caliber Lapua Magnum round, which is a rimless bottlenecked round manufactured by Nammo Lapua Oy of Lapua, Finland. However, the modular rifle system 400 can include other magazine well portions 408.

Because the various magazine well portions 408 accept magazines that may hold rounds of varying sizes, the plurality of upper receivers 404 is provided. Each upper receiver 404 includes a barrel 410 that is sized and shaped to receive rounds of a particular size or range of sizes, and each upper receiver 404 includes an opening (not shown) that is sized and positioned so that the rounds can be communicated by the magazine through the opening and into the barrel 410. As shown, the plurality of upper receivers 404 include an upper receiver 404A configured for use with either .223 caliber rounds or 9 mm rounds, an upper receiver 404B configured for use with either .308 caliber rounds, .30-06 caliber rounds, or 7.62 mm rounds, and an upper receiver 404C configured for use with .338 caliber rounds. However, the modular rifle system 400 can include other upper receivers 404.

Thus, some of the upper receivers 404 are suited for use with multiple different magazine well portions 408, while each magazine well portion 408 is suited for use with a predetermined one of the plurality of upper receivers 404. The predetermined upper receiver 404 is predetermined to ensure that rounds of the corresponding size can be communicated through the opening into the barrel 110, and that the barrel 110 is appropriately sized and shaped for firing the rounds.

For example, the upper receiver 404A is configured for use with either the .223 caliber magazine well portion 408A or the magazine well portion configured to accept a magazine of 9 mm rounds (not shown). The upper receiver 404B is configured for use with the .308 caliber magazine well portion 408B, the .30-06 caliber magazine well portion 408C, or the 7.62 mm magazine well portion 408D. The upper receiver 404E is configured for use with the .338 caliber magazine well portion 408E.

In other embodiments, each upper receiver 404 may be designed for use with only one magazine well portion 408 and each magazine well portion 408 may be designed for use with only one upper receiver 404. Alternatively, one or more upper receivers 404 may be designed for use multiple magazine well portions 408, and one or more magazine well portions 408 may be designed for use with multiple different upper receivers 404. In fact, the modular rifle system 400 may have any combination of these configurations, among others.

Thus, the illustrated modular rifle system 400 can be used to form the following modular rifles. A 9 mm modular rifle can be formed from the lower receiver portion 106, the magazine well portion configured to accept a magazine of 9 mm rounds (not shown), and the upper receiver 404A configured for use with either .223 caliber rounds or 9 mm rounds. A .223 caliber modular rifle can be formed from the lower receiver portion 106, the magazine well portion 408B configured to accept a magazine of .223 caliber rounds, and the upper receiver 404B configured for use with either .223 caliber rounds or 9 mm rounds. A .308 caliber modular rifle can be formed from the lower receiver portion 106, the magazine well portion 408B configured to accept a magazine of .308 caliber rounds, and the upper receiver 404B configured for use with each of .308 caliber rounds, .30-06 caliber rounds, and 7.62 mm rounds. A .30-06 caliber modular rifle can be formed from the lower receiver portion 106, the magazine well portion 408C configured to accept a magazine of .30-06 caliber rounds, and the upper receiver 404B configured for use with each of .308 caliber rounds, .30-06 caliber rounds, and 7.62 mm rounds. A 7.62 mm modular rifle can be formed from the lower receiver portion 106, the magazine well portion 408D configured to accept a magazine of 7.62 mm rounds, and the upper receiver 404B configured for use with each of .308 caliber rounds, .30-06 caliber rounds, and 7.62 mm rounds. A .338 caliber modular rifle can be formed from the lower receiver portion 106, the magazine well portion 408E configured to accept a magazine of .338 caliber rounds, and the upper receiver 404E configured for use with .338 caliber rounds.

So that the modular rifle system 400 can form a plurality of different rifles, each of the magazine well portions 408 includes a coupling component 434 that can releasably engage a coupling component 136 on the lower receiver portion 106, create a coupling mechanism 435. Although the coupling mechanism 435 can have a range of configurations, in the illustrated embodiment the coupling mechanism 435 has the configuration described above with reference to FIGS. 2-3. Specifically, the coupling component 434 of each magazine well portion 408 includes a recess 446 and a pin 444, while the coupling component 136 of the lower receiver portion 106 includes a connecting projection 138 and an aperture 140. To assemble the lower receiver assembly, the recess 446 on one of the magazine well portions 408 receives the connecting projection 138 on the lower receiver portion 106, and the pin 444 is moved into the aperture 140. When so coupled, the portions 106, 408 of the lower receiver assembly are releasably locked together, as described above.

Thus, even though each of the magazine well portions 408 may have a unique shape, the coupling component 434 on each of the magazine well portions 408 is substantially the same shape. Further, a rearward side 448 of each magazine well portion 408 is substantially the same shape. Specifically, the rearward side 448 is shaped to mate with a forward side 142 of the lower receiver portion 106, so that the lower receiver portion 106 can mate with any one of the magazine well portions 408. Although a variety of mating configurations are possible, in the illustrated embodiment the mating shapes have the configuration described above with reference to FIGS. 2-3. Specifically, the rearward side 448 of each magazine well portion 408 has an indent 454 and a slot 456, and the forward side 142 of the lower receiver portion 106 a ledge 150 and a projecting tab 152. When any one magazine well portion 408 is positioned adjacent the lower receiver portion 106, the portions 106, 408 of the lower receiver assembly are aligned in lateral, axial, and vertical directions, as described above.

In addition to the coupling mechanism 435 used to assemble the portions 106, 408, of the lower receiver assembly, a coupling mechanism 403 is provided that enables releasably coupling the portions 106, 408 of the assembled lower receiver assembly to the upper receiver 404. Although the coupling mechanism 403 may have a range of configurations, in the illustrated embodiments the coupling mechanism 403 is the takedown system described above with reference to FIGS. 2-3. In such an embodiment, each upper receiver 404 includes a forward connecting projection 414 and a rearward connecting projection 416. The lower receiver portion 106 includes a rearward recess 120 and a rearward pin 128, and each magazine well portion 408 includes a forward pair of connecting tabs 418 and a forward pin 426. To assemble the modular rifle, the connecting projections 114, 116 are positioned in the appropriate pair of connecting tabs 418 and recess 120, and the pins 426, 128 are moved to releasable lock the components together. When so assembled, portions 106, 408 of the lower receiver assembly and the upper receiver 404 are maintained in lateral, axial, and vertical alignment, as described above.

In some embodiments, the modular rifle system 400 is keyed so that a modular rifle can be formed by coupling the lower receiver assembly to the predetermined upper receiver 404 but not to other upper receivers 404. The keyed configuration may reduce the risk of coupling the magazine well portion 408 to an inappropriately sized upper receiver 404, creating a safety hazard.

For example, the illustrated coupling mechanism 403 is designed such that each upper receiver 404 can be coupled to the lower receiver portion 106, and can separately be coupled to each magazine well portion 408. Therefore, it may be possible to attempt forming a modular rifle using improperly matched upper receivers 404 and magazine well portions 408, creating a safety hazard. To obviate this risk, the illustrated modular rifle system 400 is keyed by varying the distance between the components of the takedown assembly. Specifically, each of the upper receivers 404 has connecting projections 414, 416 that are separated by a distance, and on each of the upper receivers 404, the distance between the connecting projections 414, 416 is different. For example, the connecting projections 414, 416 on the upper receiver 404A are separated by a distance D1, the connecting projections 414, 416 on the upper receiver 404B are separated by a distance D2, and the connecting projections 414, 416 on the upper receiver 404C are separated by a distance D3. Similarly, each of the lower receiver assemblies has forward connecting tabs 418 and the rearward recess 120 that are separated by a distance, and the distance is selected so that the lower receiver assembly can only be coupled to the predetermined upper receiver 404. However, when the magazine well portion 408 is coupled to the incorrect upper receiver 404, the lower receiver portion 106 cannot be coupled to the upper receiver 404, because the rear connecting projection 416 on the upper receiver does not align with the rear recess 120 on the lower receiver portion 106.

For example, when the .223 caliber magazine well 408A is coupled to the lower receiver portion 106, the pin 426 on the magazine well 408 and the pin 128 on the lower receiver portion 106 are separated by a distance that is substantially the same as the distance D1 between the connecting projections 414, 416 of the upper receiver 404A, which is sized for receiving .223 caliber rounds. Therefore, the lower receiver assembly can be coupled to the upper receiver 404A, but not the upper receiver 404B or 404C.

In other embodiments, the modular rifle system 400 may be keyed in other manners. For example, the coupling mechanism 403 may be configured such that the magazine well portion 408 can be coupled to the predetermined upper receiver 404, but not to other upper receivers 404. In such embodiments, the magazine well portion 408 may have a coupling component that is shaped to mate with only the predetermined upper receiver 404, but not the other upper receivers 404.

The disclosed modular rifle system 400 enables forming a plurality of different modular rifles using the same lower receiver portion 106, so that different magazines can be accepted that have different shapes and/or hold different sized rounds. In embodiments in which the lower receiver portion 106 is an M16-style lower receiver portion 106, an M16-style modular rifle can be created that fires .338 caliber rounds. For example, the M16-style modular rifle may fire the .338 caliber Lapua Magnum rounds described above.

Figure 5:
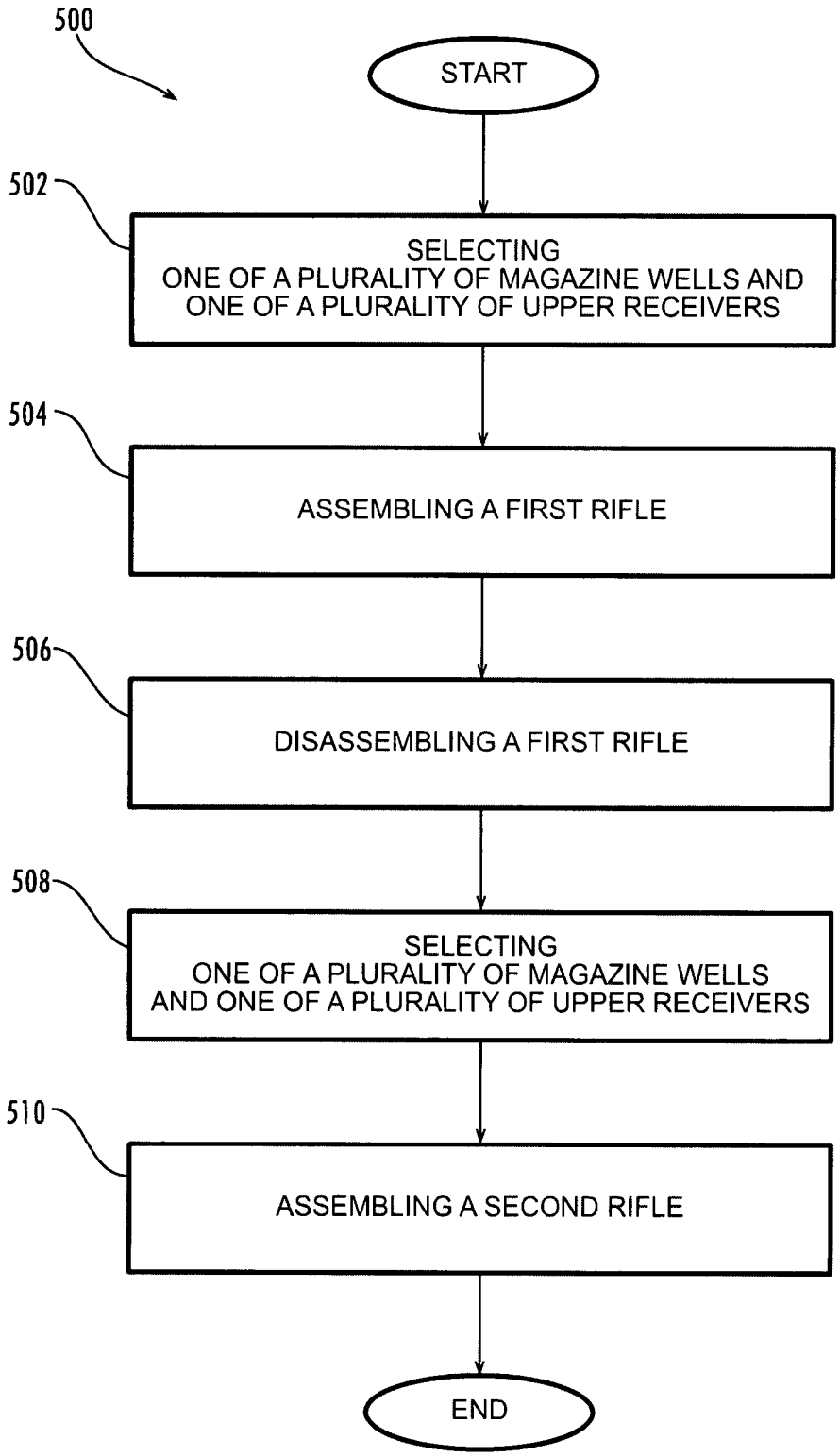
FIG. 5 is a block diagram of an embodiment of a method of forming a plurality of independent rifles.

FIG. 5 is an embodiment of a method 500 of forming a plurality of independent modular rifles. In block 502, one of a plurality of magazine wells is selected and, one of a plurality of upper receivers is selected. In block 504, a first rifle is assembled by attaching a lower receiver portion to the first selected magazine well and the first selected upper receiver. In block 506, the first rifle is disassembled. In block 508, one of the plurality of magazine wells is selected and one of the plurality of upper receivers. It should be noted that the magazine well selected in block 508 may be the same or different from the magazine well selected in block 502, and the upper receiver selected in block 508 may be the same or different from the upper receiver selected in block 502. In block 510, a second rifle is assembled by attaching the lower receiver portion to the second selected magazine well and the second selected upper receiver. The second rifle may be different from the first rifle, in that the second rifle may have a different magazine well and/or upper receiver than the first rifle.

Figure 6:
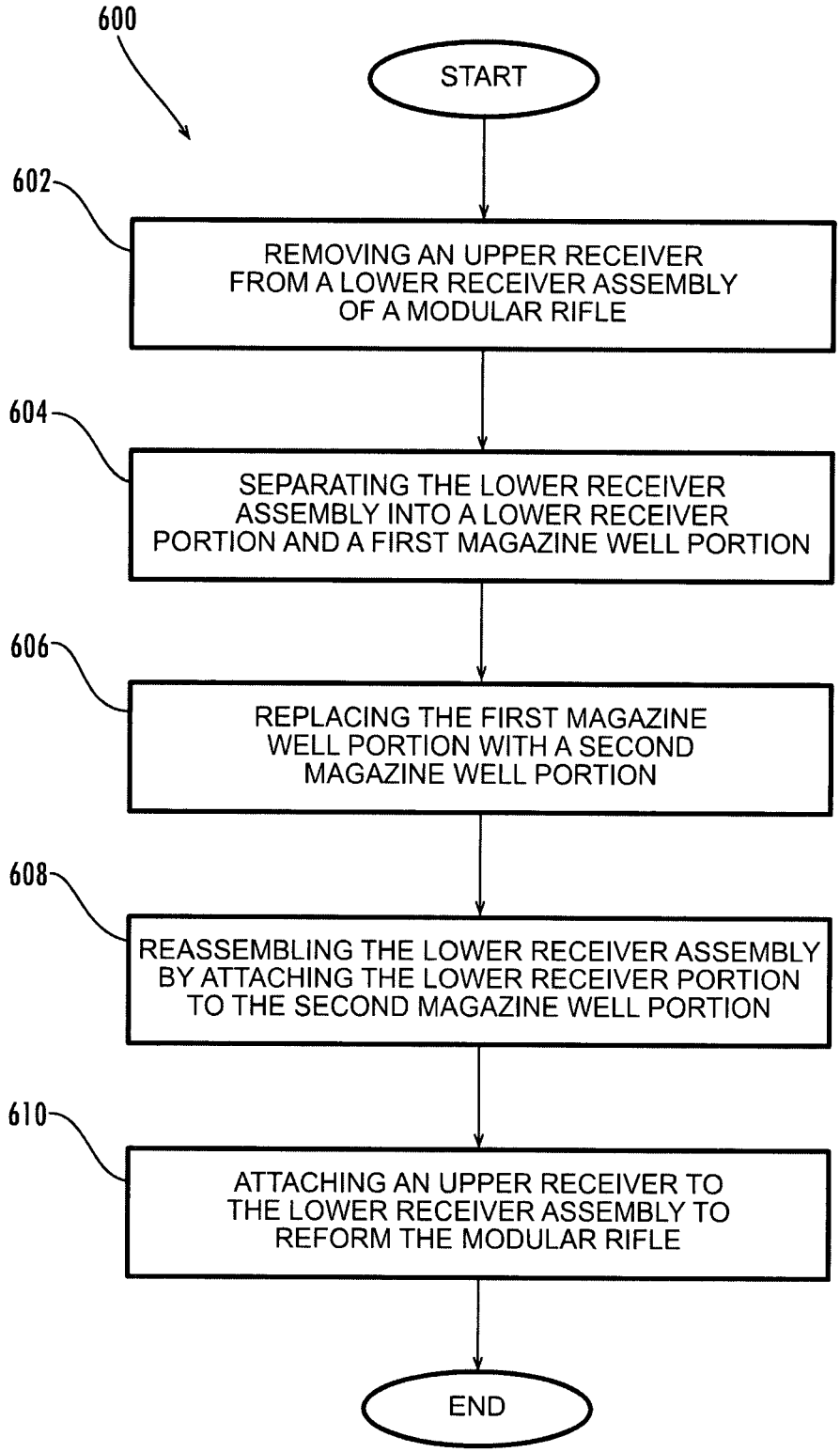
FIG. 6 is a block diagram of an embodiment of a method of reconfiguring a rifle.

FIG. 6 is an embodiment of a method 600 of reconfiguring a modular rifle. In block 602, an upper receiver is removed from a lower receiver assembly of the modular rifle. In block 604, the lower receiver assembly is separated into a lower receiver portion and a first magazine well portion. For example, separating the lower receiving assembly may comprise removing a pin on the first magazine well portion from an aperture on the lower receiver portion.

In block 606, the first magazine well portion is replaced with a second magazine well portion. The second magazine well portion may be different from the first magazine well portion in, for example, size and shape. The second magazine well portion may also be configured to accept a magazine holding rounds of a different size than the magazine accepted by the first magazine well portion.

In block 608, the second magazine well is attached to the lower receiver portion to reassemble the lower receiver assembly. For example, reassembling the lower receiver assembly may comprise moving a pin on the second magazine well through the aperture on the lower receiver portion.

In block 610, an upper receiver is attached to the lower receiver assembly to form the reconfigured rifle. In some embodiments, the upper receiver that is attached to the lower receiver assembly in block 610 is the same upper receiver that was removed from the lower receiver assembly in block 602. In other embodiments, the upper receiver attached to the lower receiver assembly in block 610 is a different upper receiver than the upper receiver that was removed from the lower receiver assembly in block 602. For example, the upper receiver that was removed from the lower receiver assembly in block 602 may be specifically configured for use with the first magazine well, while the upper receiver attached to the lower receiver assembly in block 610 may be specifically configured for use with the second magazine well.

While particular embodiments of modular rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

The invention claimed is:

1. A modular rifle comprising:

a lower receiver assembly that can be separated into a lower receiver portion and a magazine well portion;

a coupling mechanism configured to releasably couple the portions of the lower receiver assembly together, the coupling mechanism including an aperture and a pin that can be moved into and out of the aperture; and an upper receiver that is releasably coupled to the lower receiver assembly, wherein:

a rearward side of the magazine well portion has an indent shaped to mate with a ledge on a forward side of the lower receiver portion, the indent and the ledge aligning the magazine well portion and the lower receiver portion in axial and vertical directions, and the rearward side of the magazine well portion has a slot shaped to mate with a projection on the forward side of the lower receiver portion, the slot and the projection aligning the magazine well portion and the lower receiver portion in a lateral direction.

2. The modular rifle of claim 1, wherein:

the lower receiver portion is an M16-style lower receiver portion, the magazine well portion is sized and shaped to receive a magazine holding .338 caliber rounds, and the upper receiver includes a barrel that is sized and shaped to receive .338 caliber rounds from the magazine.

3. The modular rifle of claim 1, wherein:

the magazine well portion is configured to receive a magazine holding rounds of a particular size, and the magazine well portion can be separated from the lower receiver piece and replaced with a different magazine well portion, the different magazine well portion being configured to receive a different magazine holding rounds of a different size.

4. The modular rifle of claim 3, wherein:

the upper receiver includes a barrel shaped to fire rounds of the particular size, and the upper receiver can be separated from the lower receiver assembly and replaced with a different upper receiver, the different upper receiver being configured to fire the rounds of the different size.

5. The modular rifle of claim 1, wherein the modular rifle is keyed such that the upper receiver and lower receiver assembly can be coupled together in the intended orientation only.

6. The modular rifle system of claim 1, wherein the coupling mechanism further includes:

a connecting projection, the aperture being formed through the connecting projection, and a recess, the pin being positioned adjacent the recess, such that the lower receiver portion can be releasably coupled to the magazine well portion by placing the connecting projection into the recess and moving the pin through the aperture.

7. The modular rifle system of claim 6, wherein:

the connecting projection and aperture extend from a forward side of the lower receiver portion, and the recess and pin are positioned adjacent a rearward side of the magazine well portion.

8. The modular rifle of claim 1, further comprising:

a second pin and aperture, the second pin and aperture being configured to releasably couple the upper receiver to the lower receiver portion; and a third pin and aperture, the third pin and aperture being configured to releasably couple the upper receiver to the magazine well portion, forming the modular rifle.

9. A modular rifle system comprising:

a lower receiver portion;

a plurality of upper receivers, each upper receiver being configured to releasably couple to the lower receiver portion; and a plurality of magazine well portions, each magazine well portion being configured to releasably couple to the lower receiver portion and to at least one of the upper receivers, and a modular rifle being formed by releasably coupling the lower receiver portion to a selected one of the magazine well portions and a selected one of the upper receivers, wherein each upper receiver includes two apertures spaced apart from each other by a distance, the distance between the two apertures being different on each of the upper receivers.

10. The modular rifle system of claim 9, wherein:

the plurality of magazine well portions includes:

a magazine well portion that accepts a magazine of .223 caliber rounds, a magazine well portion that accepts a magazine of .338 caliber rounds, and the plurality of upper receivers includes:

an upper receiver sized to accept .223 caliber rounds, an upper receiver sized to accept .338 caliber rounds.

11. The modular rifle of claim 10, wherein:

the plurality of magazine well portions further includes:

a magazine well portion that accepts a magazine of 9 mm rounds, a magazine well portion that accepts a magazine of .308 caliber rounds, a magazine well portion that accepts a magazine of .30-06 caliber rounds, a magazine well portion that accepts a magazine of 7.62 mm rounds, and the plurality of upper receivers further includes an upper receiver sized to accept each of .308 caliber rounds, .30-06 caliber rounds, and 7.62 mm rounds, and the upper receiver sized to accept .223 caliber rounds is further sized to accept 9 mm rounds.

12. The modular rifle system of claim 9, wherein:

each upper receiver includes a uniquely sized barrel and a uniquely sized opening, and each magazine well portion accepts a magazine that holds uniquely sized rounds, each magazine well portion being suited for use with a predetermined one of the plurality of upper receivers so that the rounds in the magazine can be communicated through the opening into barrel, and the barrel is suited for firing the rounds.

13. The modular rifle system of claim 9, wherein the modular rifle system is keyed such that a modular rifle can be formed by coupling the lower receiver portion and the magazine well portion to the predetermined upper receiver, but not other upper receivers.

14. The modular rifle system of claim 9, further comprising:

a first pin configured to releasably couple the lower receiver portion to the selected one of the upper receivers;

a second pin configured to releasably couple the lower receiver portion to the selected one of the magazine well portions; and a third pin configured to releasably couple the selected one of the upper receivers to the selected one of the magazine well portions, forming the modular rifle.

15. The modular rifle system of claim 9, wherein:

the lower receiver portion includes a first coupling component; and each magazine well portion includes a second coupling component configured to engage the first coupling component, such that a secure and releasable connection can be created between the lower receiver portion and anyone of the magazine well portions.

16. The modular rifle system of claim 9, wherein each magazine well portion has a rearward side that is shaped to mate with a forward side of the lower receiver portion, the rearward side of each magazine well portion being the same shape so that the lower receiver portion can mate with anyone of the magazine well portions.

17. A modular rifle system comprising:

a first magazine well portion configured to receive a first magazine;

a second magazine well portion configured to receive a second magazine, the second magazine being different in shape than the first magazine;

a lower receiver portion configured to releasably couple to anyone of the magazine well portions, a first lower receiver assembly being formed by coupling the lower receiver portion to the first magazine well portion and a second lower receiver assembly being formed by coupling the lower receiver assembly portion to the second magazine well portion;

a first upper receiver configured to releasably couple to the first lower receiver assembly to form a first rifle; and a second upper receiver configured to releasably couple to the second lower receiver assembly to form a second rifle, wherein:

the lower receiver portion includes a rear pin, the first magazine well portion includes a first front pin, the first front pin being a first distance from the rear pin when the first magazine well portion and the lower receiver portion are coupled together to form the first lower receiver assembly, the second magazine well portion includes a second front pin, the second front pin being a second distance from the rear pin when the second magazine well portion and the lower receiver portion are coupled together to form the second lower receiver assembly, the first upper receiver includes two first apertures spaced apart from each other by the first distance, such that the first rifle can be formed by extending the rear pin and the first front pin through the first apertures, and the second upper receiver includes two second apertures spaced apart from each other by the second distance, the second distance being different from the first distance, such that the second rifle can be formed by extending the rear pin and the second front pin through the second apertures.

18. The modular rifle system of claim 17, wherein:

the first magazine well portion is configured to receive a magazine holding rounds of a first size, the first upper receiver is configured for use with the rounds of the first size, the second magazine well portion is configured to receive a magazine holding rounds of a second size, the second size being different from the first size, and the second upper receiver is configured for use with the rounds of the second size.

* * * * *